United States Patent [19]

Schick

[11] Patent Number: 4,898,301

[45] Date of Patent: Feb. 6, 1990

[54] COLLAPSIBLE CONTAINER FOR FLOWABLE MEDIA

[76] Inventor: Henning Schick, Poststrasse 11, D-7843 Heitersheim, Fed. Rep. of Germany

[21] Appl. No.: 315,459

[22] Filed: Feb. 23, 1989

[30] Foreign Application Priority Data

| | | | |
|---|---|---|---|
| Feb. 25, 1988 | [DE] | Fed. Rep. of Germany | 8802437[U] |
| Apr. 12, 1988 | [DE] | Fed. Rep. of Germany | 8804786[U] |
| Apr. 12, 1988 | [DE] | Fed. Rep. of Germany | 8804787[U] |
| Apr. 26, 1988 | [DE] | Fed. Rep. of Germany | 8805513[U] |
| Aug. 13, 1988 | [EP] | European Pat. Off. | 88113182.5 |

[51] Int. Cl.[4] ..... B65D 5/00; B65D 30/00

[52] U.S. Cl. ..... 220/408; 220/404; 220/441

[58] Field of Search ..... 220/402, 403, 404, 408, 220/441; 141/390, 391, 316, 114

[56] References Cited

U.S. PATENT DOCUMENTS

| | | | |
|---|---|---|---|
| 2,973,119 | 2/1961 | Parker | 220/441 |
| 3,067,923 | 12/1962 | Thiets | 220/441 |
| 3,143,249 | 8/1964 | Merrill et al. | 220/441 |
| 3,206,094 | 9/1965 | Humphrey et al. | 220/441 |
| 3,917,154 | 11/1975 | Dove | 220/441 |
| 4,341,337 | 7/1982 | Beach, Jr. et al. | 220/408 |
| 4,457,456 | 7/1984 | Derby et al. | 141/114 |
| 4,742,951 | 5/1988 | Kelly et al. | 220/408 |
| 4,786,192 | 11/1988 | Graves et al. | 220/403 |

FOREIGN PATENT DOCUMENTS

| | | | |
|---|---|---|---|
| 3629258 | 3/1988 | Fed. Rep. of Germany | 220/402 |
| 2395913 | 7/1977 | France | 220/403 |
| 1022538 | 3/1966 | United Kingdom | 220/441 |

*Primary Examiner*—Stephen Marcus
*Assistant Examiner*—Stephen Castellano
*Attorney, Agent, or Firm*—Peter K. Kontler

[57] ABSTRACT

A container for storage of flowable media has a deformable fluidtight inner envelope, a deformable fluidtight outer envelope and a collapsible frame between the two envelopes. The frame has two mirror symmetrical sections which are pivotally connected to each other along two parallel first fold lines, and each section has two second fold lines which are parallel to the first fold lines and divide the respective section into a median panel and two outer panels. The median panels carry pivotable flaps at both ends, and each outer panel carries at its ends pivotable triangular reinforcing elements. The frame is made of cardboard and can be erected by exerting pressure against the outer sides of the first fold lines. This causes the panels of each section to pivot relative to each other along the second fold lines while the outer envelope folds the flaps. The flaps form the top and bottom end walls of the erected frame, and the reinforcing elements enhance the stability of the frame at its ends. Strips of adhesive tape are used to prevent collapse of the once erected frame. A nozzle extends through registering openings of the two envelopes and a flap of the frame and is bonded to the two envelopes.

33 Claims, 4 Drawing Sheets

COLLAPSIBLE CONTAINER FOR FLOWABLE MEDIA

BACKGROUND OF THE INVENTION

The invention relates to containers in general, particularly to containers for flowable media of pasty or liquid consistency, and more particularly to improvements in collapsible containers. Still more particularly, the invention relates to improvements in containers of the type wherein a collapsible structure confines a deformable envelope and the envelope has a sealable opening for admission or evacuation of flowable media.

It is already known to replace conventional rigid metallic cans (such as gasoline cans) with collapsible containers which occupy little room in collapsed condition and can be erected or expanded preparatory to admission of selected quantities of flowable media into their internal spaces. Such collapsible containers are often used for storage of highly viscous or pasty, flowable solid or readily flowable liquid substances.

Certain presently known collapsible containers are assembled of deformable envelopes (hereinafter called bags for short) and collapsible boxes of corrugated board. The box surrounds and confines the bag, and the bag is assembled of two mirror symmetrical halves which are welded to each other to define a cavity for reception of a flowable medium. The halves of the bag are made from a suitable plastic material by deep drawing. When not in use, several bags can be telescoped into or otherwise assembled with each other independently of the boxes to occupy little room in storage and/or during transport.

Another conventional collapsible container, known as "bag in box", is used primarily for storage of beverages and includes a bag which is made of plastic foil and is confined in a box of corrugated board. The box can be erected around the bag to permit convenient filling as well as to protect the filled bag during storage or in transit.

A drawback of the aforedescribed conventional collapsible containers is that they cannot be readily manipulated and cannot be readily filled in automatic filling machines. This is due to the fact that the deformable bags of conventional two-piece containers cannot be conveniently attached to the spout of an automatic metering, filling or decanting machine. All this contributes to higher cost of the filled containers.

Published German patent application No. 30 16 466 discloses a two-piece collapsible container which employs a bag made from a length of flexible thermally welded tubular plastic material within a collapsible and erectable cardboard box. The bag is formed with an opening which is sealable by a closure. The opening is defined by a rigid mouthpiece which is supported by a plate having projections which are receivable in complementary notches provided therefor in the internal surface of the box. This ensures that the inlet of the mouthpiece is maintained in a predetermined position and orientation as soon as the plate is properly installed in and is properly secured to the box. Thus, the plate is intended to perform several functions including supporting the mouthpiece, maintaining the mouthpiece in a predetermined orientation, and coupling the corresponding portion of the bag to the box. The main purpose of the plate is to facilitate the admission of flowable material into the bag. This container exhibits the drawback that erection of the cardboard box and attachment of the plate to the notched portion of the box take up too much time. It is further necessary to close the bottom of the box before the latter can properly receive and confine the bag. In addition, the material (cardboard) of the box is likely to be moistened during admission of a liquid medium into the bag, as a result of leakage of liquid medium from the confined bag and/or as a result of leakage of liquid medium from the bag in an adjoining container if two or more containers are stored on a shelf or in a larger receptacle.

Published German patent application No. 24 37 670 discloses a collapsible container which is used for reception of arrays of flowers or for reception of soil if the container is to be used as a flower pot. The container is fluidtight and is assembled of a collapsible and erectable box in the interior of a deformable outer bag. The outer bag is made of plastic foil. Erection of the confined box results in enlargement of the internal space of the outer bag so that the resulting suction in the bag entails an inward folding of overhanging portions of the bag. This is intended to result in the making of a twin-walled bag, namely a bag having an inner wall within the erected box and an outer wall surrounding the erected box. When erected, the box constitutes a hollow body having a polygonal cross-sectional outline and being confined between loosely hanging inner and outer walls of the bag. The top of the container is open and its bottom wall can support soil for the roots of a relatively small plant or a piece of foamed plastic material which is supposed to support an array of flowers. The just described container is used primarily as a substitute for flower pots or flower trays but is not suitable for confinement of pastes, other viscous substances, liquids, flowable solid materials or similar media which must be fully confined during storage and/or during transport.

OBJECTS OF THE INVENTION

An object of the invention is to provide a novel and improved collapsible container which can be used for shorter or longer-lasting storage of flowable media, which occupies little room in collapsed condition, which can be erected with little loss in time, which can be reliably held in erected position for any desired period of time, and which can be filled and evacuated in a simple and convenient manner.

Another object of the invention is to provide a container wherein the liquid contents are reliably protected in transit and/or storage, which can be furnished in any desired size and in a number of practical and eye-pleasing shapes, and wherein uncontrolled escape of confined flowable medium is prevented in a number of ways.

A further object of the invention is to provide the container with novel and improved means for protecting from damage those parts which are in direct contact with the confined flowable medium.

An additional object of the invention is to provide a container which can be used for storage of neutral as well as highly corrosive or otherwise aggressive media.

Still another object of the invention is to provide a container which can be readily sterilized prior to admission of a particular flowable medium or subsequent to evacuation of its contents.

Another object of the invention is to provide a container wherein the part or parts consisting of or containing a material which would be likely to be affected (e.g., weakened, destroyed or contaminated) by the confined medium are reliably maintained out of contact with the medium during admission, during storage and/or during evacuation of the medium.

A further object of the invention is to provide a container which can be readily filled in automatic metering, filling or decanting machines.

An additional object of the invention is to provide a container which can be readily manipulated for the purposes of erection as well as for the purposes of transport in filled condition.

A further object of the invention is to provide a novel and improved method of assembling the above outlined container.

An additional object of the invention is to provide a novel and improved blank for use in the above outlined container.

SUMMARY OF THE INVENTION

The invention is embodied in a container which can be used with particular advantage for storage of flowable media, such as liquids, pastes and the like. The improved container comprises an inner envelope, an outer envelope, and an erectable and collapsible frame between the two envelopes. The inner envelope comprises a deformable bag having a first opening for admission or evacuation of media. The frame surrounds the bag and includes (when in collapsed condition) two overlapping substantially planar sections and two palallel first fold lines hingedly connecting the sections to each other. Each section has a plurality of panels and second fold lines which are parallel to the first fold lines and hingedly connect the panels to each other. At least one of the sections further comprises two flaps for at least one panel of the at least one section and two third fold lines which are normal to the first fold lines and hingedly connect the flaps to the at least one panel. The sections are pivotable relative to each other along the first fold lines, the panels of each section are pivotable relative to each other along the respective second fold lines, and the flaps are pivotable relative to the at least one panel along the corresponding third fold lines for erection of the frame preparatory to admission of a medium into the bag. The outer envelope includes a deformable sack which surrounds the frame and has a second opening in register with the first opening, at least in erected condition of the frame.

Each of the two envelopes is preferably fluidtight save for the provision of the openings therein, and the container can further comprise a detachable closure (e.g., a bung or a screw cap) for the openings.

It is presently preferred to provide each section of the frame with three panels including a median panel and two outer panels. Each section preferably comprises two flaps each of which is hingedly connected to the respective median panel. The median panels are disposed at a predetermined distance from each other in erected condition of the frame, and the sack preferably extends beyond the third fold lines by approximately one-half of such predetermined distance in collapsed condition of the frame.

The frame can be made (at least in part) of cardboard or corrugated board. It is presently preferred to make the frame of a single blank of relatively stiff material and to configurate the blank in such a way that the erected frame has a polygonal outline. The flaps are preferably coplanar with the respective median panels in collapsed condition of the frame, and the sack can automatically pivot the flaps relative to the respective median panels in response to pivoting of the panels along the first and second fold lines. The panels together form a tubular enclosure for the bag in erected condition of the frame. Such enclosure can have a substantially square or rectangular cross-sectional outline.

The container can further comprise means for facilitating opening of the sack in order to afford access to the frame and to the bag. Such facilitating means can include one or more tear strips each of which can be pulled to merely provide a straight or otherwise configurated slit in the sack or at least one of which can be pulled to actually separate a first part of the sack from a second part, e.g., to provide a window which is large enough to permit withdrawal of the frame and of the bag from the second part of the sack.

The container can further comprise a nozzle in the aforementioned opening or openings. The frame is preferably provided with a third opening (e.g., in one of the flaps) which registers with the first and second openings, at least in erected condition of the frame. The nozzle can comprise a first portion which is affixed to the bag, and a second portion which is affixed to the sack. The third opening is disposed between the first and second portions of the nozzle intermediate the first and third openings. The first portion of the nozzle can be sealingly bonded to the first envelope and/or the second portion of the nozzle can be sealingly bonded to the second envelope. At least one of the two portions of the nozzle can include or constitute a flange which extends outwardly beyond the third opening.

In accordance with a presently preferred embodiment, the nozzle comprises a tube which extends through the first opening, a flange provided on the tube adjacent the first opening, and a ring provided on the tube adjacent the second opening. The flange constitutes the aforementioned first portion, and the ring constitutes the aforementioned second portion of the nozzle. The ring and the tube comprise cooperating detent means for maintaining the ring at a selected distance from the flange. The detent means can comprise a male detent element and a complementary female detent element; one of these elements is provided on the ring and the other detent element is provided on the tube. The flange can be disposed in the interior of the bag, and the ring can be inwardly adjacent the second opening.

The container can further comprise means for preventing the once erected frame from reassuming the collapsed position. Such preventing means can comprise at least one adhesive-coated strip. The strip can be applied to the sack and can constitute a handgrip portion. Such strip can extend between two spaced-apart portions of the sack which are adjacent the first fold lines. Reinforcing means can be provided adjacent such spaced-apart portions of the sack, and the reinforcing means are preferably provided on the frame.

In accordance with a presently preferred embodiment, the reinforcing means comprise a substantially triangular reinforcing element at each end of each outer panel, and each reinforcing element is hingedly connected to the respective outer panel. Furthermore, each reinforcing element of one of the two sections is hingedly connected to a reinforcing element of the other section by an additional fold line constituting an extension of one of the first fold lines. The reinforcing elements which are hingedly connected to each other by the additional fold lines jointly form triangles having hypotenuses adjacent the respective outer panels.

The width of each flap can equal or approximate the width of the corresponding median panel, and the height of each flap can equal or approximate the width of an outer flap.

The frame and/or the envelopes can be made of a thermally sterilizable material, such as cardboard, corrugated board, aluminum foil and/or metal-coated plastic foil.

The novel features which are considered as characteristic of the invention are set forth in particular in the appended claims. The improved container itself, however, both as to its construction and the mode of making and manipulating the same, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
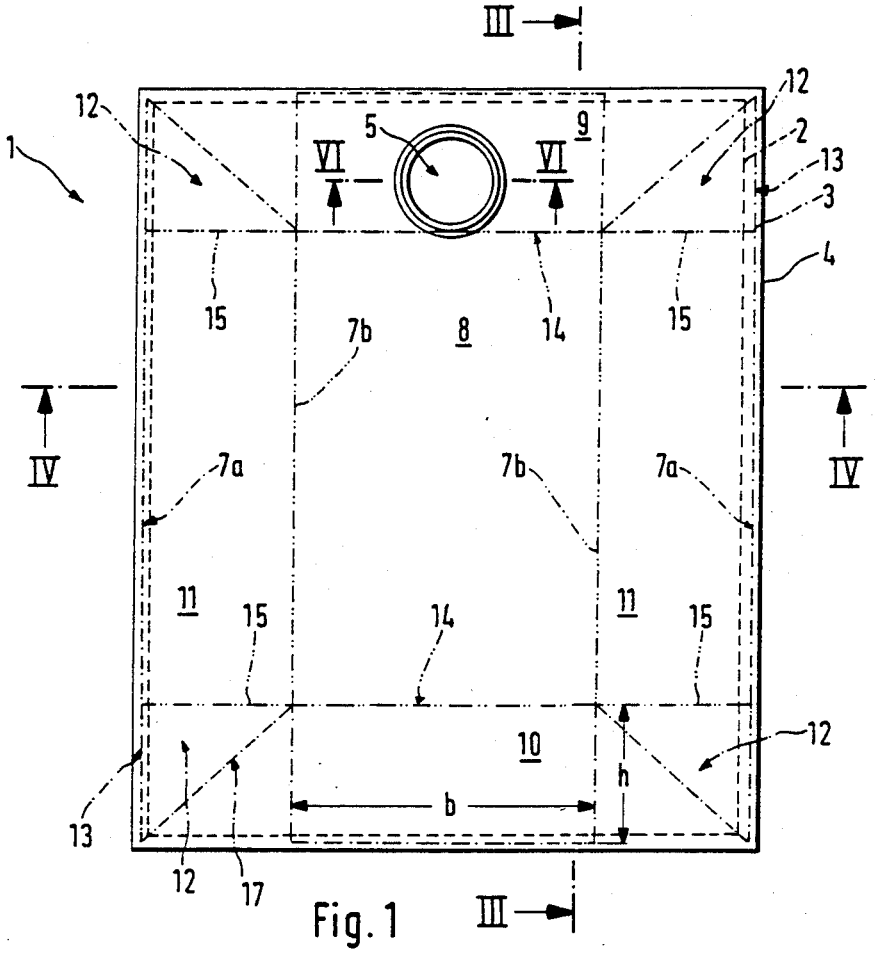
FIG. 1 is an elevational view of an improved container in collapsed condition of its frame.
Figure 5:
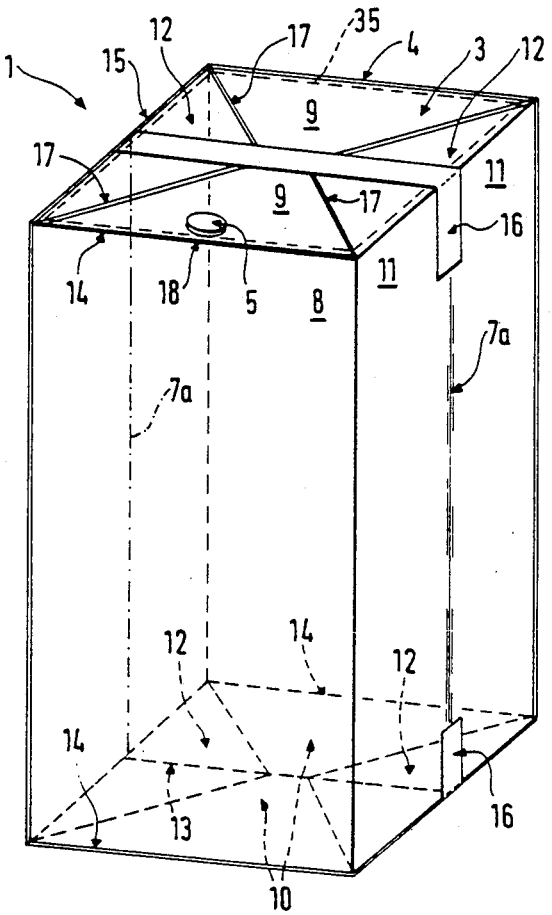
FIG. 5 is a perspective view of the container in erected condition of the frame.

FIG. 1 shows the improved container 1 in collapsed condition of its frame 3, and FIG. 5 shows the frame of the container in erected or expanded condition. In addition to the frame 3, the improved container 1 comprises a deformable inner envelope 2 (hereinafter called bag for short), a deformable outer envelope 4 (hereinafter called sack for short), a nozzle 18 (see particularly FIG. 6), and a detachable closure 5. The bag 2 is confined in the frame 3, and the latter is confined in the sack 4. The bag 2 is fluidtight save for an opening 2A which serves for admission of a flowable medium into the interior of the bag by way of the nozzle 18 (in erected condition of the frame 3) or for evacuation of such medium by way of the nozzle. Analogously, the sack 4 is airtight save for an opening 4A which registers with the opening 2A and surrounds an intermediate portion of the nozzle 18. The frame 3 has a third opening 23 which is disposed between the openings 2A, 4A and surrounds the nozzle 18. The diameter of the opening 23 may but need not match that of the opening 2A and/or 4A (it is assumed here that the openings 23, 2A and 4A are circular openings).

FIGS. 1 to 4 show that the frame 3 comprises two preferably identical halves or sections 6 which overlap and are immediately or closely adjacent each other in collapsed condition of the frame. When erected, the frame 3 has a polygonal (preferably square or rectangular) cross-polygonal sectional outline (FIG. 5). The entire frame 3 is made of a one-piece blank which is then converted into a relatively short or elongated tube having a total of four sidewalls and two end walls. The sections 6 are integrally connected to each other by two spaced-apart parallel primary weakened portions or first fold lines 7*a* (note particularly FIGS. 2 and 4) which enable the adjacent (outer) panels 11 of the sections 6 to pivot relative to each other during erection or during collapsing of the frame 3. In addition to the two first fold lines 7*a*, the frame 3 comprises four second or secondary fold lines 7*b* which are parallel to each other and to the first fold lines 7*a*. As can be readily seen in FIGS. 2 and 4, each section 6 has two fold lines 7*b* which connect the respective outer panels 11 with a central or median panel 8. If the erected frame 3 has a square cross-sectional outline, the width of each median panel 8 equals or closely approximates the combined width of two outer panels 11. The panels 8, 11, 11 of each section 6 are substantially coplanar in collapsed condition of the frame 3. During erection of the frame 3, the neighboring outer panels 11 of the two sections 6 pivot relative to each other to increase the angles along the inner sides of the respective fold lines 7*a*, and the outer panels 11 of each section 6 further pivot relative to the respective median panel 8 to reduce the angles along the inner sides of the respective fold lines 7*b*. When the frame 3 is fully erected, the median panels 8 constitute two parallel sidewalls of the resulting tubular body, and pairs of neighboring (coplanar) outer panels 11 constitute two additional sidewalls which alternate with the sidewalls or median panels 8.

Each section 6 further comprises two rectangular flaps 9, 10 which are integrally connected to the respective ends of the corresponding median panel 8 by third fold lines 14 extending at right angles to the fold lines 7*a* and 7*b*. The flaps 9, 10 extend outwardly and are coplanar or nearly coplanar with the respective median panels 8 in collapsed condition of the frame 3. When the frame 3 is erected, the flaps 9 jointly constitute the entire top wall or a portion of the top wall of the resulting hollow polygonal body, and the flaps 10 jointly constitute the entire bottom wall or a portion of the bottom wall of the polygonal body. The aforementioned opening 23 is provided in one of the flaps 9.

The frame 3 is further provided with reinforcing means in the form of eight triangular reinforcing elements 12 each of which is a rightangled triangle. Each element 12 is integrally connected with one end of an outer panel 11 by an additional fold line 15 which extends at right angles to the fold lines 7*a*, 7*b* and is an extension of one of the four fold lines 14 in collapsed condition of the frame 3. Furthermore, the neighboring triangular reinforcing elements 12 of the sections 6 are integrally connected to each other by fold lines 13 which are in register with and constitute extensions of the respective fold lines 7*a* in collapsed condition of the frame 3. Each outer panel 11 is coplanar or substantially coplanar with the respective pair of reinforcing elements 12 in collapsed condition of the frame 3. In other words, the arrowsheads of lead lines of the four reference characters 12 which are shown in FIG. 1 point toward pairs of overlapping triangular reinforcing elements. When the frame 3 is erected, the hypotenuses 17 of the reinforcing elements 12 overlap the respective flaps 9 or 10.

The outer envelope or sack 4 is closely adjacent the outer sides of the sections 6 in collapsed condition of the frame 3, and this sack extends only slightly beyond the ends of the panels 8 and 11, namely by half the distance between the median panels 8 in erected condition of the frame. In order to erect the frame, the person in charge exerts slight pressure against the outer sides of the fold lines *7a* to push such fold lines toward each other. This causes the panels 8 and 11 of both sections 6 to pivot relative to each other in directions to move neighboring pairs of outer panels 11 into two spaced-apart parallel planes. At the same time, the sack 4 automatically folds or pivots the flaps 9, 10 from the positions of coplanarity with the respective median panels 8 to positions at right angles to the planes of the median panels. The erected frame 3 defines an internal space which permits admission of a flowable medium into the bag 2 via nozzle 18 so that the bag can be filled to a desired extent, e.g., completely so that its configuration matches or approximates that of the erected frame 3. Exertion of pressure against the outer sides of the fold lines 7a entails a movement of the median panels 8 away from each other simultaneously with an increase of angles between the internal surfaces of pairs of neighboring outer panels 11 until the frame 3 is fully erected, i.e., erection of the frame 3 which is shown in the drawing is completed when each outer panel 11 is substantially or exactly coplanar with the neighboring outer panel.

Figure 2:
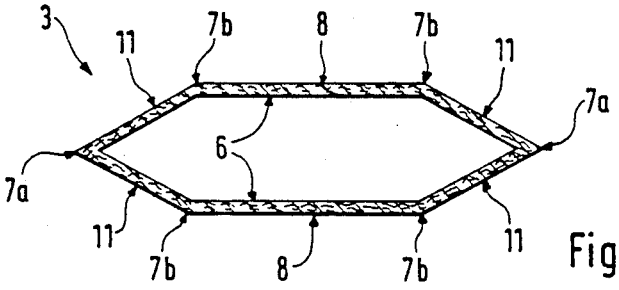
FIG. 2 is a cross-sectional view of the frame in partly erected condition.

FIG. 2 shows the frame 3 (without the flaps 9, 10 and reinforcing elements 12) in partly erected condition in which the pairs of neighboring outer panels 11 are still inclined relative to each other and the distance between the median panels 8 is less than the combined width of two coplanar neighboring outer panels 11 (or twice the width of a single outer panel 11 if the width of each outer panel is the same). Erection of the frame 3 progresses in response to continued application of pressure against the outer sides of the fold lines *7a*, i.e., in response to further movement of fold lines *7a* toward each other. When the erection of the frame 3 is completed, the flaps 9 are disposed in a common plane to constitute the top wall of the frame 3, and the flaps 10 are also located in a common plane to define the bottom wall of the erected frame. As mentioned above, pivoting of the flaps 9 toward each other and pivoting of the flaps 10 toward each other during erection of the frame 3 is automatic or practically automatic if the dimensions of the sack 4 are selected with a view to cause the material of the sack to flex along the fold lines 14. The reinforcing elements 12 are thereupon pivoted along the respective fold lines 15. Pivoting of the reinforcing elements 12 along the fold lines 15 is normally effected by hand subsequent to erection of the frame 3.

The means for preventing collapse of the fully erected frame 3 comprises two adhesive-coated strips 16 which are caused to overlie the outer side of the sack 4 in such a way that they extend over the abutting or closely adjacent edges of the flaps 9 and flaps 10 as well as over the respective sets of reinforcing elements 12. As can be seen in FIG. 5, the upper adhesive strip 16 overlaps a total of four folded-over reinforcing elements 12 along the upper fold lines 13, and the lower strip 16 overlaps the other four reinforcing elements 12 along the lower fold lines 13. The end portions of the strips 16 overlie the end portions of the fold lines *7a*. Such application of the strips 16 ensures that the erected frame 3 retains its shape as long as necessary and provides room for expansion of the bag 2 during admission of flowable material through the nozzle 18.

Figure 3:
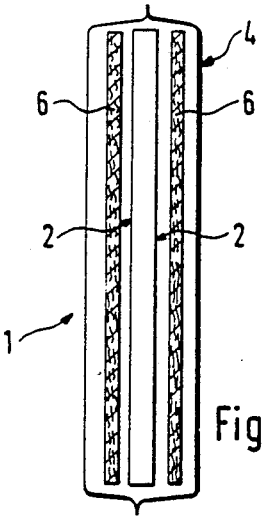
FIG. 3 is a smaller-scale sectional view of the container as seen in the direction of arrows from the line III—III of FIG. 1.
Figure 4:
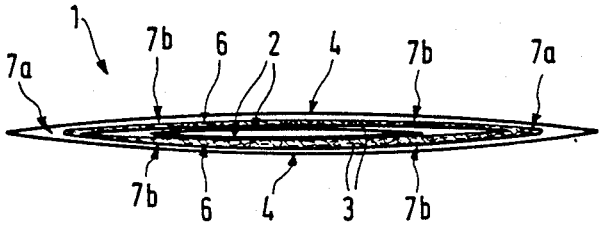
FIG. 4 is a sectional view of the container as seen in the direction of arrows from the line IV—IV of FIG. 1.

FIGS. 3 and 4 show the frame 3 in fully or nearly fully collapsed condition. The two sections 6 of the collapsed frame 3 are immediately or closely adjacent each other but provide room for the deformable bag 2 between them. The frame 3 is made of corrugated board (e.g., a corrugated board between two flap outer boards). As mentioned above, the sack 4 can closely surround the frame 3 in collapsed or erected condition, and this sack is preferably fluidtight (the same as the bag 2) save for the opening 4A (and the opening 2A of the bag 2). The corrugations of the board of which the frame 3 is made preferably extend in parallelism with the fold lines *7a* and *7b*. This enhances the stability of the frame 3 in erected and/or collapsed condition. In other words, the corrugations extend from the flaps 9 toward the respective flaps 10, and from the reinforcing element 12 at one end of each outer panel 11 toward the reinforcing element 12 at the other end of the respective outer panel. It is preferred to make the bag 2 as well as the sack 4 of a thermally sterilizable material, i.e., a material which can be sterilized in response to the application of heat and can stand temperatures which are required for proper sterilization of the bag 2 and sack 4 prior to admission of a certain type of flowable medium into the interior of the bag 2.

FIG. 4 shows that the container 1 is a flat body which occupies little room in collapsed condition of the frame 3. Numerous containers 1 can be stacked on top of or next to each other in collapsed condition of their respective frames 3 to facilitate storage, transport and other handling.

FIG. 5 shows that the illustrated container 1 has a square cross-sectional outline in erected condition of the frame 3 If the median portions of the strips 16 are not coated with adhesive, each of these strips can be used as a handle or handgrip member to facilitate manipulation of the container 1 irrespective of whether the bag 2 is filled, partly filled or empty. The strips 16 overlie and adhere to the respective twin pairs of reinforcing elements 12 which enhance the stability of the entire container 1 in erected condition of the frame 3. The strength of the strips 16 can be readily selected in such a way that each of these strips can be used as a handgrip member or handle for the lifting and transfer of a relatively large container 1 which is filled with a flowable medium of high specific weight. Of course, this also necessitates proper selection of the strength of the sack 4.

When the reinforcing elements 12 are folded over in a manner as shown in FIG. 5, the reinforcing elements of each pair of coherent elements 12 together constitute a larger right-angled triangle (see also FIG. 7) having a hypotenuse extending along the neighboring outer panels 11 and two sides formed by the hypotenuses 17 of reinforcing elements 12 of the respective pair. The reinforcing elements 12 can be flexed or otherwise deformed (either by hand or by the sack 4) toward the overlapped portions of the flaps 9 and 10 to facilitate grasping of the median portion of selected strip 16 when the latter is used as a handle.

Figure 7:
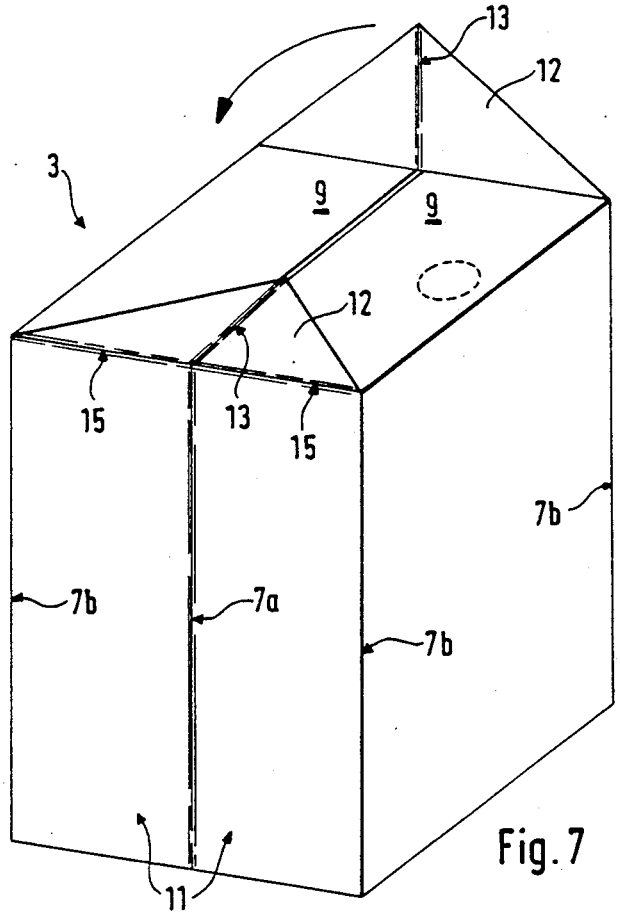
FIG. 7 is a perspective view of a frame in erected condition but with two reinforcing elements in positions prior to attachment to the other two reinforcing elements at the top of the container.
Figure 8:
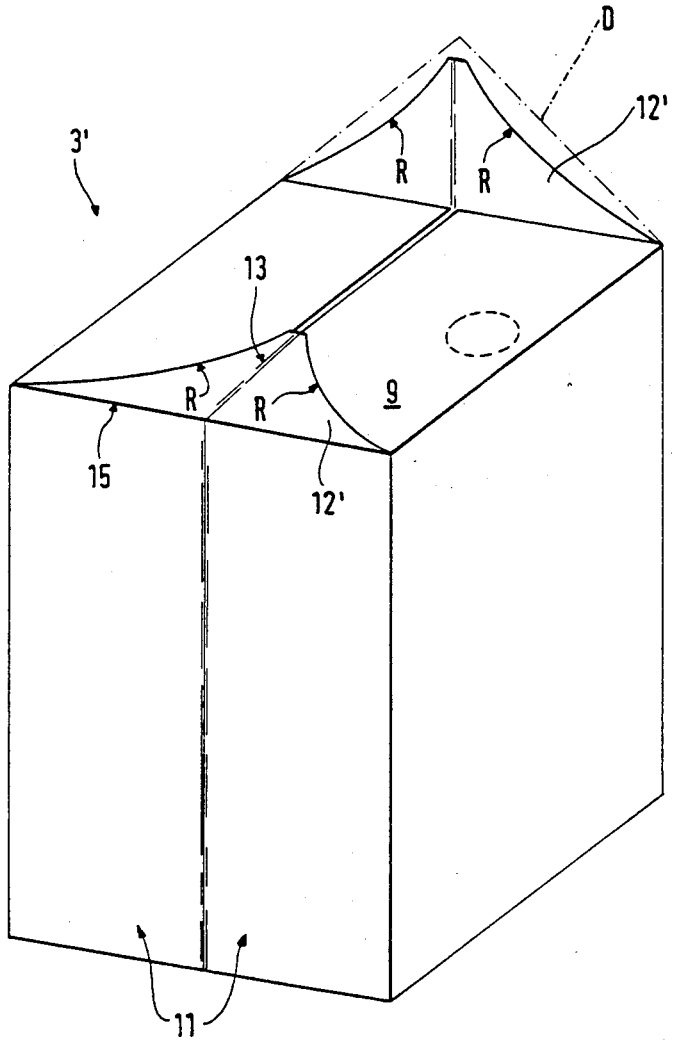
FIG. 8 is a perspective view of a frame in a condition corresponding to that of the frame of FIG. 7 but with modified reinforcing elements.

FIG. 8 shows a frame 3' which is identical with the frame 3 of FIG. 7 except that it has modified reinforcing elements 12' with concave edges R replacing the straight hypotenuses 17 of the reinforcing elements 12. Care should be taken to ensure that the pairs of interconnected reinforcing elements 12' do not extend beyond imaginary right-angled triangles one of which is shown at D. This ensures that the reinforcing elements 12' cannot interfere with erection of the frame 3' within the confines of a sack 4. An advantage of the frame 3' is that the handle including the two pairs of triangles 12' (and an adhesive strip 16, not shown in FIG. 8) can be more readily grasped by the fingers of one hand than a handle having four triangular reinforcing elements.

Four fingers of the hand lifting the container 1 are slipped beneath the top strip 16 and beneath the top four reinforcing elements 12 above that portion of the sack 4 which overlies the coplanar flaps 9. The composite handle includes the top strip 16 and the adjacent reinforcing elements 12. Each reinforcing element 12 is disposed between two layers of the material of the sack 4 in erected condition of the frame 3.

FIG. 1 shows that the width b of each median panel 8 equals the width of the respective flaps 9 and 10. Furthermore, the height h of each flap 9 or 10 preferable equals half the distance (b) between the median panels 8 in fully erected condition of the frame 3. This ensures that the sack 4 need not extend outwardly beyond the flaps 9 and 10 when the frame 3 is collapsed. The height h of each flap 9 or 10 further equals the width of an outer panel 11. This ensures that, when the frame 3 is erected, the two flaps 9 jointly form a practically uninterrupted top wall and the two flaps 10 form a similar bottom wall of the frame. The reinforcing elements 12 of the erected frame 3 overlie the gaps (if any) between the narrow sides of the folded flaps 9, 10 and the adjacent outer panels 11 as well as portions of the gaps (if any) between the abutting or closely adjacent edges of the flaps 9 at the top and of the flaps 10 at the bottom of the container 1. This can be readily seen in FIG. 5.

If the composition of flowable material which is admitted into the bag 2 is such that the bag must be discarded as soon as the flowable material is evacuated by way of the nozzle 18, the sack 4 is preferably provided with means for facilitating opening of the sack for the purpose of removing the bag 2 from the interior of the frame 3. The illustrated facilitating means comprises a standard tear strip 35 which can be designed to permit the formation of a slit in the sack 4 or to permit complete removal of a selected portion (e.g., the top part) of the sack 4. The presently preferred locus for the tear strip 35 is along the edges of the top wall of the sack 4. The tear strip can include a thread or a narrow band.

Figure 6:
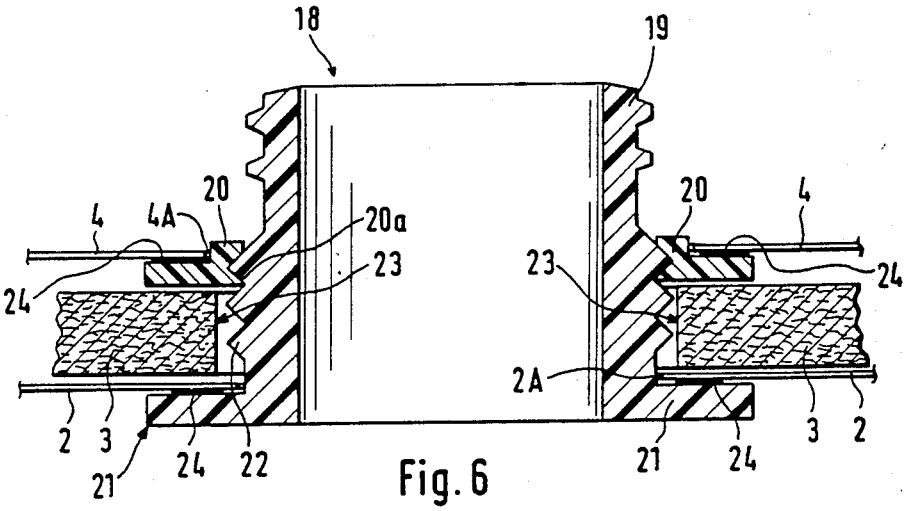
FIG. 6 is a greatly enlarged sectional view as seen in the direction of arrows from the line VI—VI of FIG. 1, with the closure removed.

The details of a presently preferred nozzle 18 are shown in FIG. 6. The illustrated nozzle includes an elongated pipe or tube 19 which can be made of a plastic material and is integral with an enlarged portion 21 in the form of a flange which is disposed in the interior of the bag 2 and is welded, glued or otherwise sealingly bonded to the material of the bag around the opening 2A. A second enlarged portion of the nozzle 18 is a discrete ring 20 which surrounds the pipe 19 and is welded, glued or otherwise sealingly bonded to the inner side of the sack 4 around the opening 4A. The flange 21 and the ring 20 flank the respective flap 9 of the frame 3 in the region around the opening 23. In order to prevent leakage of confined fluid medium along the exterior of the pipe 19, the latter is provided with male detent elements in the form of circumferentially complete corrugations or with a male detent element in the form of a thread, and the ring 20 is provided with one or more complementary female detent elements 20*a* for reception of a selected male detent element 22. It is clear that one or more male detent elements can be provided on the ring 20 to sealingly engage one or more female detent elements on the pipe 19. It is also possible to replace the separately produced ring 20 with a second integral flange of the pipe 19.

The diameter of the opening 23 in the respective flap 9 of the frame 3 is smaller than the diameters of the flange 21 and ring 20, at least along portions of the circumference of the pipe 19.

It has been found that the nozzle 18 renders it possible to automatically introduce desired quantities of a flowable medium into the bag 2 in erected condition of the frame 3 in spite of ready deformability of the material of the bag. Admission of metered quantities of flowable material (or admission of flowable material until the bag 2 is filled) can be carried out in existing automatic or semiautomatic filling, metering or decanting machines.

The likelihood of uncontrolled escape of flowable material from the interior of the bag 2 is remote or nil, especially if the bag 2 is sealingly connected to the flange 21 and if the sack 4 is sealingly connected to the ring 20, and even more so if the ring 20 is in sealing engagement with the pipe 19 of the nozzle 18. The locations where the bag 2 and the envelope 4 are respectively welded or otherwise sealingly bonded to the flange 21 and ring 20 are indicated at 24. The sack 4 will confine the escaping fluid medium if the bond between the flange 21 and the bag 2 is damaged or destroyed as long as the bond between the sack 4 and the ring 20 remains intact.

The closure 5 can constitute a standard bung or plug which is a friction fit in or which is threadedly connectable with the outer end portion of the pipe 19.

The fold lines can be formed by scoring, perforating and/or otherwise weakening selected portions of the blank which is to be converted into the frame 3.

The sack 4 performs several important functions, namely (a) preventing the escape of confined flowable medium in the event of leakage of the bag 2, (b) shielding the frame 3 from external influences (such as contact with moisture which could result in softening and collapse of the erected frame), and (c) assisting in rapid and predictable erection of the frame 3 in response to the application of pressure against the outer sides of the fold lines 7*a*. In order to effectively assist in properly erecting the frame 3, the sack 4 preferably closely or relatively closely follows the outline of the collapsed frame. This ensures automatic pivoting of the flaps 9, 10 when the fold lines 7*a* are caused to approach each other. It has been found that the illustrated frame 3 is particularly suited for erection with assistance from the sack 4 without the formation of creases or pleats by the material of the sack and without any shifting (or any appreciable shifting) of portions of the sack relative to the adjacent panels, flaps and reinforcing elements of the frame.

The sack 4 is particularly desirable and advantageous when the bag 2 is to confine a flowable medium which should be reliably confined in the container. Thus, if the bag 2 develops a leak or becomes separated from the nozzle 18, the container 1 can still effectively prevent the escape of confined medium into the surrounding area because the leaking medium is intercepted by the sack 4 (as long as the closure 5 continues to seal the outer end of the pipe 19). Leakage of flowable medium from the container 1 could result in damage or injury as well as in contamination of one or more neighboring containers. This could affect the sales appeal of the contaminated containers and could also affect the stability of neighboring containers if such neighboring containers were devoid of an outer envelope.

The improved container can be used with advantage in areas where the purity of air is of considerable or utmost importance. This, too, is attributable to dual protection or confinement of flowable media by the inner and outer envelopes of the container. For example, if the container is used for storage of flowable solid media, the particles of such media cannot escape into the surrounding atmosphere even if the inner envelope (bag 2) is damaged and permits the confined medium to contact the frame 3 and the internal surface of the sack 4. Thus, the sack 4 contributes significantly to the versatility and reliability of the improved container.

The frame 3 can remain in collapsed condition until shortly or immediately prior to start of admission of a flowable medium into the bag 2. This ensures that the space requirements of the improved container are increased only when the container is about to accept a supply of flowable medium. Since the erected frame 3 completely surrounds the bag 2, the latter is highly unlikely to be damaged in the absence of the application of a force which would entail pronounced deformation and/or partial or complete destruction of the erected frame. The latter can stand pronounced deforming stresses, especially subsequent to the application of adhesive strips 16. The material surrounding the opening 23 in the frame 3 prevents uncontrolled tilting of the pipe 19 so that the nozzle 18 remains in an optimum position for admission of a flowable medium into the bag 2, e.g., in an automatic filling machine. The likelihood of unintentional separation of the nozzle 18 from the bag 2 and sack 4 is reduced if the bag is welded to the outer side of the flange 21 and the sack is welded to the outer side of the ring 20. This enhances the resistance of welded connections 24 to destruction during admission of a flowable medium via pipe 19.

A frame 3 which is made of cardboard or corrugated board is capable of standing pronounced stresses. Moreover, such frame is inexpensive and its weight is low. The making of the frame from a one-piece blank also contributes to lower cost of the frame and of the entire container. The polygonal shape of the blank enhances the stability of the erected frame between the bag 2 and the sack 4.

The tear strip 35 can be used with advantage in sacks 4 which serve to surround frames 3 for bags 2 which are damaged, or likely to be damaged, beyond repair as a result of contact with an aggressive flowable medium. The tear strip 35 ensures that the damaged bag 2 can be removed without affecting the condition of the frame so that the latter can be reused in another container. Removal of a damaged or contaminated bag 2 from the frame 3 is also desirable if the bag is to be disposed of separately, i.e., not with the frame 3 and sack 4.

Each of the three main components of the improved container can be made of a material which is sterilizable by heating. As mentioned above, the frame 3 can be made of cardboard or corrugated board. The bag 2 and/or the sack 4 can be made of aluminum foil or metal-coated plastic foil.

An important advantage of the improved container is that it occupies little room in storage and/or transit, that its frame can be readily erected or collapsed without resorting to any tools, that it offers double security against the escape of confined media, and that the bag can be filled in automatic machines. The stability of the container in erected condition of the frame is surprisingly high, and the container can be readily manipulated without necessitating the provision of discrete handles or the like, i.e., the means for preventing collapse of the erected frame can also serve as a handgrip member. The erected frame is preferably designed to impart to the container a shape which renders it possible to stack identical or similar containers on top of as well as next to each other, e g., on shelves, in larger boxes or crates and elsewhere. The sack can be made of a material which is not readily stretchable or cannot be stretched at all to thus further enhance the stability of the container in erected condition of the frame. Moreover, the frame practically completely or completely confines the bag and thus reduces the likelihood of accidental damage to the bag; this is particularly important when the container is used for storage of expensive or aggressive flowable materials. Still further, the sack automatically folds certain parts (flaps) of the frame during erection of the frame so that the frame automatically assumes an optimum shape as soon as the erecting step is completed. The sack can intercept any flowable material which happens to escape from the bag except by way of the nozzle 18.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A container, particularly for flowable media, comprising an inner envelope including a deformable bag having a first opening for admission or evacuation of flowable media; an erectable and collapsible frame surrounding said bag and including, in the collapsed condition thereof, two overlapping sections and two parallel first fold lines hingedly connecting said sections to each other, each of said sections having a plurality of panels and second fold lines parallel to said first fold lines and hingedly connecting the panels to each other, at least one of said sections further comprising two flaps for at least one of said panels of said at least one section and two third fold lines normal to said first fold lines and hingedly connecting said flaps to said at least one panel, said sections being pivotable relative to each other along said first fold lines, the panels of each of said sections being pivotable relative to each other along the respective second fold lines and said flaps being pivotable relative to said at least one panel along the corresponding third fold lines for erection of said frame preparatory to admission of a flowable medium into said bag; and an outer envelope including a deformable sack surrounding said frame and having a second opening in register with said first opening; at least in erected condition of said frame.

2. The container of claim 1, wherein said bag and said sack are fluidtight save for the provision of said openings therein, and further comprising a detachable closure for said openings.

3. The container of claim 1, wherein each of said sections comprises three panels including a median panel and two outer panels, each of said sections including two flaps hingedly connected with the respective median panels.

4. The container of claim 3, wherein said median panels are disposed at a predetermined distance from each other in erected condition of said frame, said sack extending beyond said third fold lines by approximately one-half of said distance in collapsed condition of said frame.

5. The container of claim 1, wherein said frame consists of cardboard.

6. The container of claim 1, wherein said frame consists of corrugated board.

7. The container of claim 1, wherein said frame consists of a single blank of stiff material and has a polygonal outline in the erected condition thereof.

8. The container of claim 7, wherein said flaps are coplanar with said at least one panel in collapsed condition of said frame and said sack pivots said flaps relative to said at least one panel in response to pivoting of said panels along said first and second fold lines.

9. The container of claim 1, wherein said flaps are substantially coplanar in collapsed condition of said frame and said panels together form a tubular enclosure for said bag in erected condition of said frame.

10. The container of claim 9, wherein said enclosure has a substantially rectangular cross-sectional outline.

11. The container of claim 1, further comprising means for facilitating opening of said sack to afford access to said frame and said bag.

12. The container of claim 11, wherein said means for facilitating opening of said sack comprises a tear strip.

13. The container of claim 1, further comprising a nozzle in one of said openings.

14. The container of claim 13, wherein said frame has a third opening in register with said first and second openings, at least in erected condition of said frame.

15. The container of claim 14, wherein said nozzle has a first portion affixed to said bag and a second portion affixed to said sack, said third opening being disposed between said first and second openings intermediate said first and second portions of said nozzle.

16. The container of claim 15, wherein at least one of said portions is bonded to the respective envelope.

17. The container of claim 15, wherein at least one of said portions includes a flange extending away from said third opening.

18. The container of claim 13, wherein said nozzle comprises a pipe extending through said first opening and a flange provided on said pipe adjacent said first opening, said nozzle further comprising a ring provided on said pipe adjacent said second opening.

19. The container of claim 18, wherein said ring and said pipe comprise cooperating detent means for maintaining said ring at a selected distance from said flange.

20. The container of claim 19, wherein said detent means comprises a male detent element and a complementary female detent element, one of said detent elements being provided on said ring and the other of said detent elements being provided on said pipe.

21. The container of claim 18, wherein said flange is disposed in said bag and said ring is inwardly adjacent said second opening.

22. The container of claim 1, further comprising means for preventing the erected frame from reassuming the collapsed condition.

23. The container of claim 22, wherein said means for preventing the erected frame from reassuming the collapsed condition comprises at least one adhesive-coated strip.

24. The container of claim 1, further comprising a handgrip portion provided on said sack.

25. The container of claim 24, wherein said handgrip portion includes a strip extending between two spaced-apart portions of said sack adjacent said first fold lines.

26. The container of claim 25, further comprising reinforcing means (12) adjacent said spaced-apart portions of said sack.

27. The container of claim 26, wherein said reinforcing means (12) are provided on said frame.

28. The container of claim 1, wherein each of said sections comprises three panels including a median panel having a predetermined width, each of said sections comprising two flaps on the respective median panel and each of said flaps having a width matching or approximating said predetermined width.

29. The container of claim 28, wherein the two remaining panels of said three panels of each of said sections are outer panels each having a predetermined width, each of said flaps having a height matching or approximating the width of said outer panel.

30. The container of claim 1, wherein said frame and said envelopes consist of a thermally sterilizable material.

31. The container of claim 30, wherein said sterilizable material is selected from the group consisting of cardboard, corrugated board, aluminum foil and metal-coated plastic foil.

32. The container of claim 1, wherein each of said sections includes two outer panels each adjacent one of said first fold lines and each having two end portions each adjacent one of said flaps, said frame further comprising reinforcing means (12) including a triangular reinforcing element hingedly connected to each end portion of each outer panel, each reinforcing element of one of said sections being hingedly connected to a reinforcing element of the other of said sections by an additional fold line constituting an extension of one of said first fold lines.

33. The container of claim 32, wherein the reinforcing elements which are hingedly connected to each other by said additional fold lines jointly form triangles having hypotenuses adjacent the respective outer panels.

* * * * *